United States Patent [19]

Mellinger et al.

[11] Patent Number: 4,578,831

[45] Date of Patent: Apr. 1, 1986

[54] TOILET FIXTURE

[76] Inventors: Mel Mellinger; Robin McPhail, both of 1412 S. Andrews Ave., Ft. Lauderdale, Fla. 33316

[21] Appl. No.: 666,759

[22] Filed: Oct. 31, 1984

[51] Int. Cl.[4] ..... E03D 11/00

[52] U.S. Cl. ..... 4/252 R; 4/300; 4/420; 4/661; 4/DIG. 15

[58] Field of Search ..... 4/252 R, 300, 661, 323, 4/321, 319, 317, 420, DIG. 15, 114.1

[56] References Cited

U.S. PATENT DOCUMENTS

| | | | |
|---|---|---|---|
| 303,027 | 8/1884 | McComb | 4/420 |
| 331,993 | 12/1885 | Moore | 4/420 |
| 3,504,381 | 4/1970 | Dewey, II | 4/321 |
| 3,587,116 | 6/1971 | Quase | 4/300 |
| 4,052,756 | 10/1977 | Whiteman et al. | 4/420 |

*Primary Examiner*—Henry K. Artis
*Attorney, Agent, or Firm*—Malin, Haley & McHale

[57] ABSTRACT

Disclosed is a toilet fixture, and supporting structure therefor, especially well adapted for use on marine vehicles, such as yachts or other pleasure craft. The supporting structure provides extra lateral support for the pedestal upon which the toilet bowl is mounted; in particular, the supporting structure opposes bending moments operating on the pedestal's stem. Additionally, the supporting structure can be made into the form of a closed cover, which is effective to prevent accidental or unauthorized tampering with the plumbing entering and exiting the toilet fixture. This prevents alteration of valve settings in this plumbing. The cover can also prevent dust accumulation on this plumbing, and in the general area at which the pedestal is joined to the floor.

12 Claims, 3 Drawing Figures

TOILET FIXTURE

BACKGROUND OF THE INVENTION

This invention pertains to toilet fixtures and their supporting structure, and is especially well-adapted for use on marine vehicles, such as yachts and other such pleasure craft.

A typical toilet fixture has a bowl mounted upon a floor by a pedestal, the pedestal having a base portion attached to the floor, and a stem portion connecting the base and bowl. When the fixture is used, unevenly distributed weight on the bowl causes bending moments all along the stem, placing stress on the stem and the bolts connecting the stem to the base. When exacerbated by rough seas, these bending moments can damage the bolts.

Moreover, typical marine toilets have exposed plumbing immediately adjacent the base and lower stem portions of the pedestal. This plumbing obstructs access to areas about the base and lower stem, making it very difficult to clean exposed areas of the base. This exposed plumbing usually contains one or more valves to control the amount and velocity of water used to flush. Because these valves are so exposed, careless users can easily bump into, or tamper with them, causing unwanted readjustment of the valves, resulting in the toilet bowl overflowing.

SUMMARY OF THE INVENTION

Accordingly, it is an object of this invention to provide an extra lateral support to oppose bending moments about the base and stem of such toilet fixtures.

It is a further object of this invention to prevent accidental and unauthorized alterations of valve settings in the plumbing for such valve fixtures.

It is a further object of this invention to prevent dust from accumulating in the vicinity of the plumbing and control valving located below the toilet bowl and about the toilet bowl's pedestal.

It is a further object of this invention to minimize the number of metal plumbing parts in contact with salt water so as to minimize corrosion.

It is a further object of this invention to increase the toilet's reliability by minimizing soft rubber and moving parts in the toilet fixture.

It is a further object of this invention to fulfill the above objects of this invention by a means that is simple and easy to manufacture, and thus cost effective to purchase.

It is a further object of this invention to provide such a means that is easy to install, use, and maintain.

In accordance with these and other objects which shall become apparent hereinafter, there is provided a pedestal support that braces the pedestal against the floor, which, in a preferred embodiment, is a planar member curved generally into the form of a dome. The large open end, or outer perimeter, of the support is fixed to the floor beneath the toilet fixture. The support has another, centrally located, opening through which the toilet pedestal extends, and to which the pedestal is attached. The particular dome shape of the support is additionally selected to form a cover over the plumbing and valving adjacent the pedestal, and thus can serve as a barrier to prevent access to this plumbing that might cause accidental resetting of them. This cover can also be solid, and flushly joined to the pedestal and floor, to prevent the entry of dust.

Preferably, the fixture's intake and outlet plumbing is made of non-metallic material to prevent corrosion by salt water, with only the flow restriction that generate a venturi being metallic. The system uses a water column to isolate this plumbing from the discharge line or holding tank, thus eliminating flapper valves commonly used to prevent backflow. These flapper valves of necessity have the kind of soft rubber and moving parts that are easily restricted.

The instant invention will be more fully understood from the following detailed description, it being understood, however, that the invention is capable of extended application, and is not confined to the precise disclosure. Changes and modifications may be made that do not affect the spirit of the invention, nor exceed the scope thereof, as expressed in the appended claims. Accordingly, the instant invention will now be described with reference to the accompanying drawings, wherein:

DETAILED DESCRIPTION OF THE INVENTION

Figure 1:
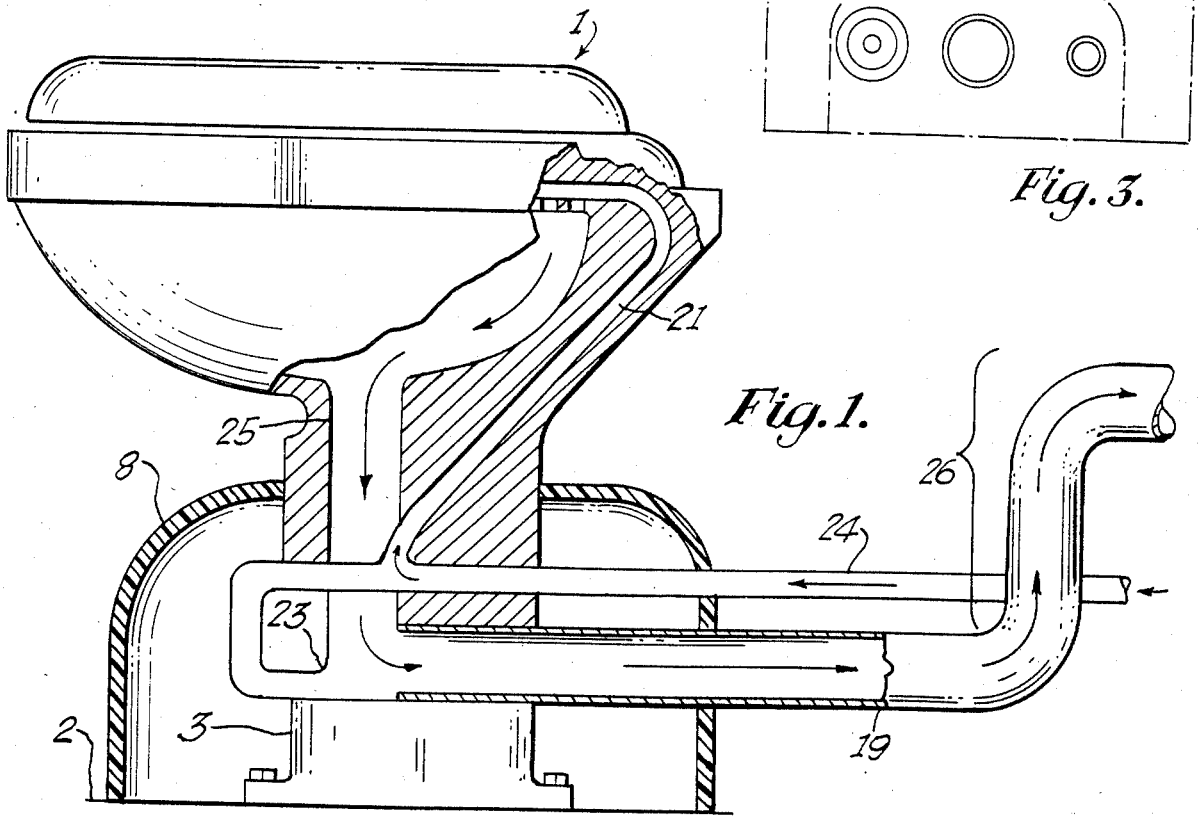
FIG. 1 is a plan view of a typical marine toilet illustrating its plumbing operation.

With reference to the drawing figures, and in particular FIG. 1, there is seen a toilet facility 1, which illustrates the operation of a typical marine toilet facility. Pedestal 3 and support 8 are shown in outline in this plan view. Intake line 24 is connected to a water supply capable of delivering a high velocity jet of water through a line 24. Tap off line 21 takes a portion of the water jet in line 24 up to the toilet bowl itself, and typically distributes it to the bowl via plural exits about the bowl's rim (the latter not shown). The remainder of the water jet in line 24 continues into venturi junction 23. The high speed of water in line 24 causes a venturi effect at 23, creating suction at 23 which pulls water and waste accumulated in the toilet bowl and pipe 25 into discharge line 19. Discharge line 19 continues through isolator section 26 to the ultimate disposal point for the waste in toilet bowl 1. Section 26 serves to isolate the upstream and downstream portions of pipe 19 because of the elevation of section 26, ensuring a static water head in pipe section 26 equal in height to the water level in the toilet itself when the toilet is not in use. By so doing, one can also dispense with the flapper valve commonly used in 26 to prevent backflow. Such flapper valves have, of necessity, soft rubber and moving parts that are easily restricted. In use, waste acumulates in the static water head in bowl 1 and passage 25 of pedestal 3. If pedestal 3 were dislodged from floor 2, or, worse, if pedestal 3 were to break under the abovedescribed bending moments, the static water head would be launched hither and yon in the lavatory. In FIG. 1, pipes 19 and 24 are shown at different elevations to facilitate understanding of the toilet's operation. In practice, 19 and 24 will be at the same elevation in order to minimize pressure drops in the toilet discharge loop, and, in FIGS. 2 and 3, these pipes are in fact illustrated at the same elevation.

Figure 2:
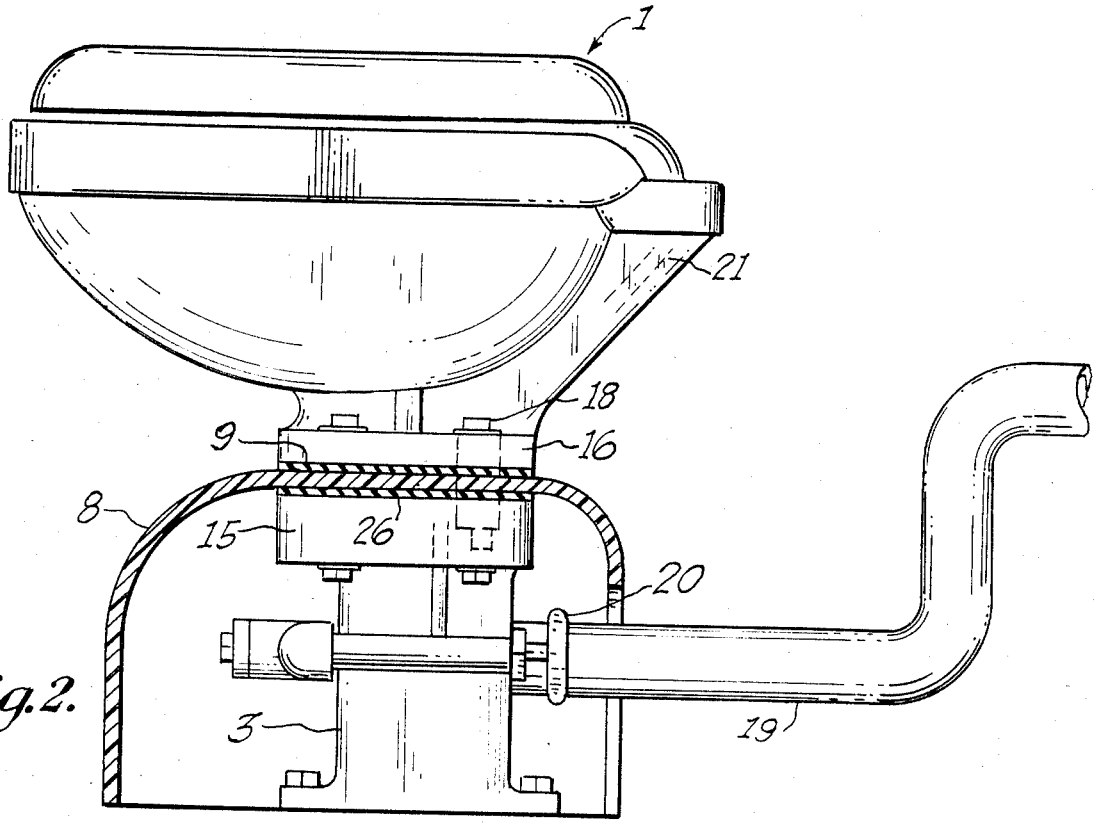
FIG. 2 is a side sectional view in the direction of 2—2 of FIG. 3, showing the base of the toilet and the toilet's plumbing lines.

With particular reference to FIG. 2 the disposition of pipes 19 and 24 in pedestal 3 supporting toilet fixture 1 is shown. Also shown in FIG. 2 is a crank or wheel 20 which controls the stem of a valve disposed in pipe 24. The valve operated by wheel 20 controls the velocity and volume of water traversing pipe 24, its proper setting being critical to the proper operation of the toilet facility. These pipes 19, 21, 22, 23, 24, 25, 26, etc. are made of non-metallic material, such as PVC or fiberglass, to prevent corrosion of these pipes by salt water. Pipe section 26, besides providing a constant water level in bowl 4 when the fixture is not in use, serves to isolate the fixture fluidically from the sewer, so as to eliminate the necessity for flapper valves, which, of necessity, have soft rubber parts that are easily restricted, and hence must be replaced often.

Figure 3:
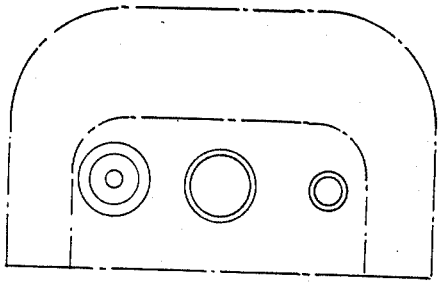
FIG. 3 is a side view of a marine toilet facility employing the instant invention. Part of the pedestal support is cut away to show the base of the fixture's pedestal and the plumbing thereabout.

With particular reference to FIG. 3, toilet bowl 4 is seen mounted and supported on pedestal 3. It is clear that during use, weight on bowl 4 causes a torque on the length of stem 17 of pedestal 3, and at base 5 of pedestal 3. To help offset this torque, and the bending moments resulting from this torque, stem 17 is buttressed by a support 8. Support 8 is a curved planar member in the form of a cover attached at its peimeter 12 to floor 2. All portions of perimeter 12 are distant from base 5 by at least a selected distance 13. Support 8 has a central opening in the vicinity of portion 9 of support 8, through which passes a portion of stem 17 and having flanged portions 15 and 16 of stem 17. Bolts 18 pass through flanged portions 15, 16, and through the perimeter of the central opening so as to rigidly fix together the upper portion of stem 17 and support 8. In this manner, bending moments normally supported only by stem 17 and base 5 are in great measure absorbed or opposed by cover 8 and distributed about its perimeter 12. All portions of the perimeter of the central opening are distant from base 5 by at least a selected distance 14. The result is a toilet fixture much more stable and much less given to bending and breakage than as is known in the prior art. Additionally, a conventional, additional clean-out entry 25 for discharge line 19 is shown. This clean-out entry provides access to the interior of pipe 19 for periodic maintenance.

Support 8 is preferably made sufficiently solid so that casual users cannot gain access to the plumbing beneath cover 8, e.g. 20, 25, etc., in other words, without tampering with the cover. This prevents accidental readjustment of line 24's control valve via wheel 20, with the unfortunate results mentioned above. Moreover, support 8 can be made fully solid, providing only such further openings as are necessary for entry of pipes 19, 24. By so doing, support 8 functions as a dust cover, preventing dust accumulation about members 5, 20, 21, 24, and 19, which common experience shows to be very aggravating to clean. Support 8 can be made advantageously of fiberglass or molded plastic. An additional advantage of this configuration is that, because the upper portion of stem 3 is subdivided into two detachable flanges 15, 16 that are necessarily tied together by bolts 18, maintenance personnel can gain ready entry into the plumbing passages within stem 17 merely by removing bolts 18 and lifting bowl 4 off the lower portion of pedestal 3. This makes periodic cleaning of the plumbing within 25, etc., much easier, and can eliminate the tedious procedure necessitated by using conventional clean-out access port 25.

The instant invention has been shown herein in what is considered to be the most practical preferred embodiment. It is recognized, however, that departures may be made therefrom within the scope of the invention, and that obvious modifications may occur to one skilled in this art. Accordingly, the scope of the instant invention is to be discerned by reference to the accompanying claims, wherein:

We claim:

1. In combination with a toilet fixture, said fixture comprising a bowl and a pedestal means for supporting said bowl on a floor, said pedestal means comprising a base means for joining said pedestal to said floor, and a stem having two ends, the first of said two ends being joined to said bowl, the other of said two ends being joined to said base means, the improvement comprising:

a support means for supporting said pedestal and opposing bending moments along said stem about said base means, one portion of said support means being joined to said stem, all portions of said one portion being distant from said base means along said stem by at least a first selected distance, another portion of said support means being joined to said floor, all portions of said another portion being distant from said base means by a second selected distance.

2. The combination of claim 1, wherein said support means is in the form of a curved planar member, said planar member having an opening central of said another portion through which is disposed said stem, the perimeter of said opening abutting said stem.

3. The combination of claim 2, wherein said stem comprises two sub-portions, each said sub-portion having a flange portion, one of said flange portions abutting said perimeter of said opening on one planar face of said planar member, the other of said flange portions abutting said perimeter of said opening on the other planar face of said planar member.

4. The combination of claim 3, wherein said support means comprises a plurality of bolt means for fixedly joining each said flange portion to said perimeter of said opening.

5. The combination of claim 4, wherein said planar member is adapted to be effective as a cover means for enclosing said base and a space above said floor, said cover means being sized and shaped to enclose in said space a portion of said plumbing means.

6. The combination of claim 5, wherein said cover means is adapted to be effective to prevent entry of dust into said space.

7. The combination of claim 1, wherein said cover means is adapted to be effective to prevent entry of dust into said space.

8. In combination with a toilet fixture adapted to be mounted on a floor and plumbing means for supplying water to said fixture, said fixture comprising a bowl and a pedestal means for supporting said bowl on said floor, said pedestal comprising a base means for joining said pedestal to said floor, said fixture further comprising a stem portion having two ends, the first of said two ends being joined to said bowl, the other of said two ends being joined to said base means, the improvement comprising:

a cover means for enclosing said base and a space above said floor, said cover means being sized and shaped to enclose in said space a portion of said plumbing means, said cover means being further sized and shaped to prevent human access to said portion of said plumbing means unless said cover means is removed or broken.

9. The combination of claim 8, wherein said cover means is in the form of a curved planar member, the perimeter of said planar member being joined to said floor, said planar member having an opening central of said perimeter through which is disposed said stem, the perimeter of said opening being joined to said stem.

10. The combination of claim 9, wherein said cover means is effective to prevent entry of dust into said space.

11. The combination of claim 7, wherein said plumbing means is a plurality of pipe sections, said plurality of pipe sections being of non-metallic material.

12. The combination of claim 11, wherein said non-metallic material is fiberglass.

* * * * *